US006109131A

United States Patent [19]

Nogle

[11] Patent Number: 6,109,131

[45] Date of Patent: Aug. 29, 2000

[54] LINEAR TRANSLATION OF PRNDL

[75] Inventor: Thomas D. Nogle, Troy, Mich.

[73] Assignee: DaimlerChrysler Corporation, Auburn Hills, Mich.

[21] Appl. No.: 09/283,073

[22] Filed: Mar. 31, 1999

[51] Int. Cl.[7] ..... B60K 20/04

[52] U.S. Cl. ..... 74/473.11; 74/337.5; 74/473

[58] Field of Search ..... 74/473.11, 337.5, 74/473.28; 137/637.1; 200/61.91; 340/456, 686

[56] References Cited

U.S. PATENT DOCUMENTS

| | | | |
|---|---|---|---|
| 712,583 | 11/1902 | Packard et al. | 74/337.5 X |
| 3,677,104 | 7/1972 | Hirozawa et al. | 74/337.5 X |
| 3,688,596 | 9/1972 | Szodfridt . | |
| 4,083,266 | 4/1978 | Kreotzberg . | |
| 4,527,448 | 7/1985 | Person . | |
| 4,541,308 | 9/1985 | Person . | |
| 4,584,906 | 4/1986 | Nagaoka . | |
| 4,637,281 | 1/1987 | Vanselous . | |
| 4,667,540 | 5/1987 | Yagi . | |
| 4,690,011 | 9/1987 | Sakai . | |
| 4,724,723 | 2/1988 | Lockhart . | |
| 4,844,127 | 7/1989 | Horsch | 74/337.5 X |
| 4,916,961 | 4/1990 | Holbrook . | |
| 5,277,078 | 1/1994 | Osborn et al. | 74/473.28 |
| 5,325,083 | 6/1994 | Nassar . | |
| 5,420,565 | 5/1995 | Holbrook . | |
| 5,794,748 | 8/1998 | Heuver . | |

*Primary Examiner*—Rodney H. Bonck
*Attorney, Agent, or Firm*—Marc Lorelli

[57] ABSTRACT

A valve assembly having an advantageous construction for directing fluid flow between a fluid source and a fluid actuating device in a transmission of a vehicle. The valve assembly includes a manual lever being actuated in response to a manual input from an operator. The manual lever is positionable in a plurality of positions corresponding to predetermined operating modes of the transmission. The assembly further includes a valve body having valve member disposed therein. The valve member being movable for directing fluid flow between the fluid source and the fluid actuating device. A plate member slidably engaging the valve body is further provided. The plate member is operably coupled to the manual lever to linearly translate the plate member relative to the valve body in response to the manual input. Cam member is included for positioning the valve member at a predetermined position corresponding to the plurality of positions of the manual lever when the plate member is linearly translated.

17 Claims, 2 Drawing Sheets

LINEAR TRANSLATION OF PRNDL

CROSS-REFERENCE TO RELATED APPLICATIONS

The present application is related to the following co-pending applications, which are incorporated herein by reference:

U.S. Ser. No. 09/282,375 for an invention entitled "PRNDL CODE USING 5 PINS"; and U.S. Ser. No. 09/282,987 for an invention entitled "CAMMING MANUAL LEVER FOR PULL-OUT LOAD."

FIELD OF THE INVENTION

The present invention relates to an automatic transmission for a vehicle and, more particularly, to a coding plate capable of being linearly translated for actuating a manual valve in an automatic transmission.

BACKGROUND OF THE INVENTION

As is well known to those skilled in the art, many automatic transmissions include manual valve assemblies capable of directing fluid flow between a fluid source and a fluid-actuating device in the transmission.

Currently, there exists an automatic transmission system having a cam controlled manual valve assembly. A thorough discussion of such a cam controlled manual valve assembly is contained in U.S. Pat. No. 4,916,961 ('961) issued on Apr. 17, 1990, to Holbrook et al. and entitled "Cam-Controlled Manual Valve In An Automatic Transmission," which is commonly owned by the assignee of the present application. This patent is hereby incorporated by reference.

With reference to FIG. 4*b* of the '961 patent, the manually actuated valve assembly includes a manual lever having a cam groove formed thereon for actuating the manual valve of the transmission. The manual lever is rotated in response to a manual input from the operator. A valve pin connected to the manual valve is disposed in camming relationship with the cam groove of the manual lever such that when the manual lever is rotated, the pin travels within the cam groove to move the manual valve to a predetermined operating mode position (PRNODDL). However, it should be appreciated that the rotational movement of the manual lever relative to the valve pin may not afford maximum protection against bind. Furthermore, the curvature of the cam groove increases the difficulty of maintaining manufacturing tolerances in the manual lever.

Recently, attempts have been made to incorporate the electronic sensing system with the manual lever. A thorough discussion of such a transmission sensing system is contained in U.S. Pat. No. 5,325,083 ('083) issued on Jun. 28, 1994 to Nassar et al. and entitled "Manual Valve Position Sensing System," which is commonly owned by the assignee of the present application. This patent is hereby incorporated by reference.

With reference to FIGS. 3 and 6 of the '083 patent, the sensing system includes a plate member that rotates in response to the shift lever and includes a cam surface at the edge with electrically conductive and non-conductive areas. An electrical sensor unit is mounted in the transmission in a position to communicate with the contact surface of the plate member. Four electrical contact pins engage the conductive and non-conductive areas on the plate member and generate a binary code having combinations thereof that represent each of the shift lever positions and transition areas. However, like the '961 patent, the technique employed in the '083 patent may not afford maximum protection against bind in the cam when the plate member rotates relative to the valve pin. Moreover, the curvature of the cam groove increases the difficulty of maintaining manufacturing tolerances in the plate member. Still further, it may be difficult to maintain manufacturing tolerances in the electrically conductive and non-conductive areas, relative to the cam groove. Variations in the placement of the conductive and non-conductive areas relative to the cam groove may lead to the transmission controller incorrectly detecting the position of the manual valve.

Accordingly, there exists a need in the relevant art to provide a valve assembly capable of accurately positioning the manual valve that overcomes the disadvantages of the prior art. Furthermore, there exists a need in the relevant art to provide a valve assembly capable of minimizing bind in the cam groove caused from rotational motion. Still further, there exists a need in the relevant art to provide a valve assembly capable of providing a plate member having conductive and non-conductive areas formed accurately relative to a cam groove to insure improved position detection by a transmission controller.

SUMMARY OF THE INVENTION

In accordance with the broad teachings of this invention, a valve assembly having an advantageous construction for directing fluid flow between a fluid source and a fluid actuating device in a transmission of a vehicle is provided. The valve assembly includes a manual lever being actuated in response to a manual input from an operator. The manual lever is positionable in a plurality of positions corresponding to predetermined operating modes of the transmission. The assembly further includes a valve body having valve means disposed therein. The valve means being movable for directing fluid flow between the fluid source and the fluid actuating device. A plate member slidably engaging the valve body is further provided. The plate member is operably coupled to the manual lever to enable the plate member to linearly translate relative to the valve body in response to the manual input. Cam means is provided for positioning the valve means at a predetermined position corresponding to the plurality of positions of the manual lever when the plate member is linearly translated.

Further areas of applicability of the present invention will become apparent from the detailed description provided hereinafter. It should be understood that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment is merely exemplary in nature and is in no way intended to limit the invention, its application, or uses.

Figure 1:
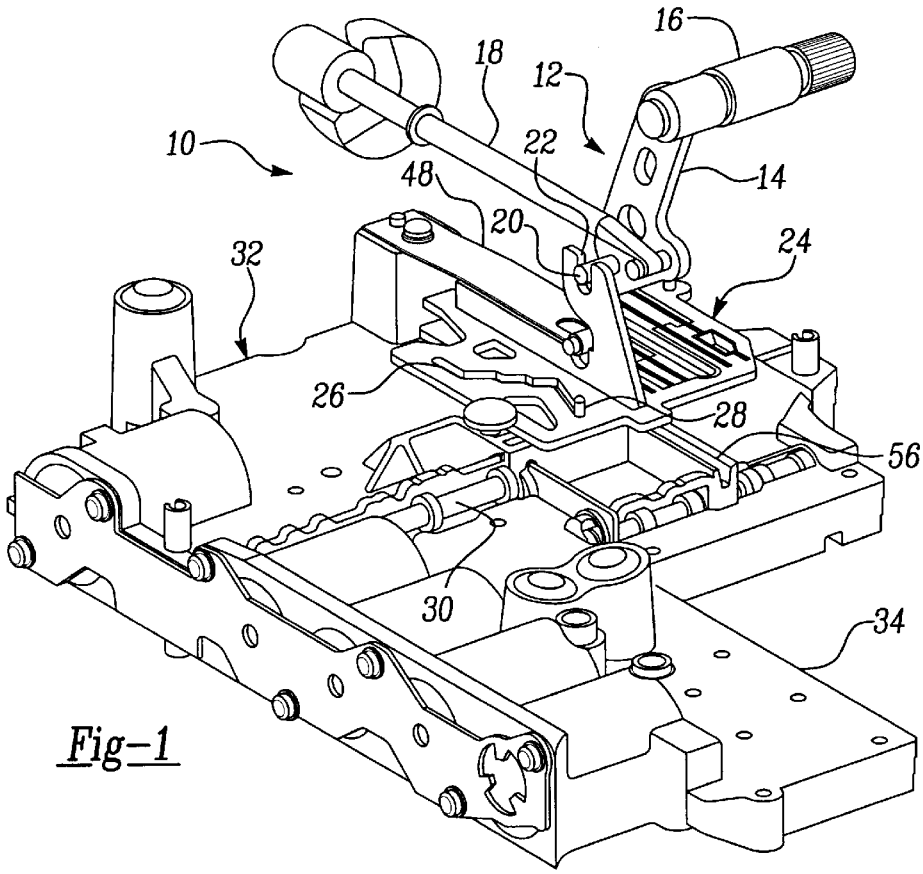
FIG. 1 is a perspective view of a valve assembly for an automatic transmission having a sensing unit removed for clarity according to the teachings of the present invention.
Figure 2:
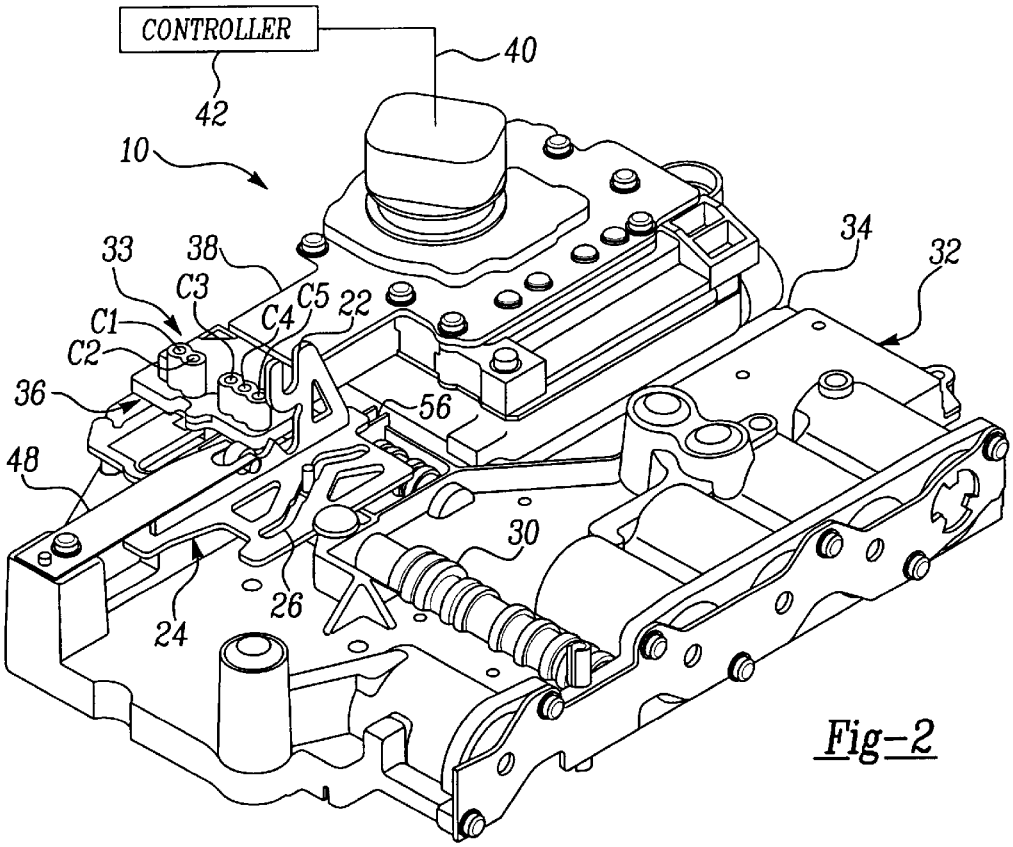
FIG. 2 is a perspective view of the valve assembly showing the sensing unit and having the manual lever removed for clarity.

Referring to FIGS. 1 and 2, valve body assembly 10 is shown therein for directing fluid flow between a fluid source (not shown) and multiple fluid-actuating devices (not shown) in a transmission of a vehicle. Valve body assembly 10 includes a manual lever assembly 12 having a manual lever 14 connected to a shaft member 16. Shaft member 16 is generally mounted within a support structure (not shown) having an opening that allows for a rotational movement of manual lever 14. Manual lever assembly 12 is attached to a shift rod (not shown) that is moveable by an operator of a vehicle to select one of a plurality of transmission operating modes, such as park, reverse, neutral, drive, second, and low (PRND2L). FIG. 1 also shows that a park pawl rod 18 is connected to manual lever 14 to permit actuation of park pawl rod 18 by manual lever assembly 12.

Figure 3:
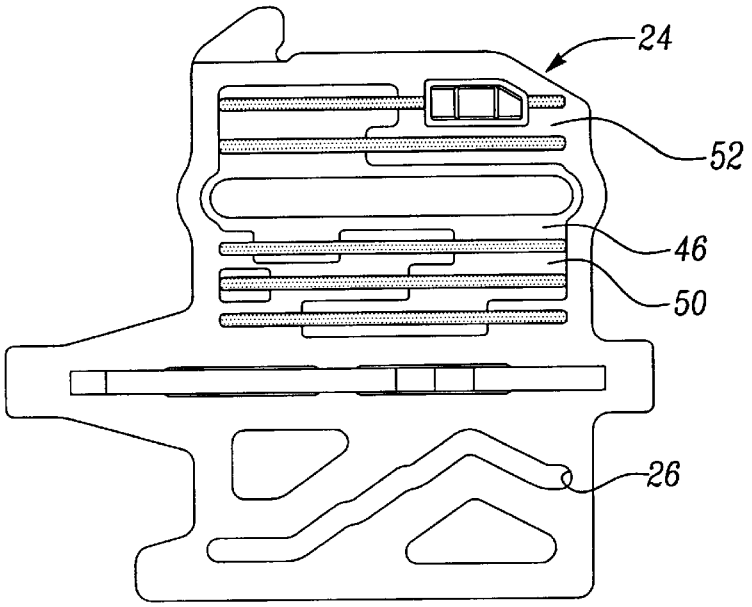
FIG. 3 is a plan view of the linearly translated plate member.

Manual lever 14 rotates in response to operator input amongst positions that generally represent operating modes for an electronically controlled automatic transmission. In doing so, manual lever 14 has a pin 20 formed on an end thereof as shown in FIG. 1, which engages a pin slot 22. Pin slot 22 is formed within a coding plate 24. Coding plate 24 has a cam surface composed of a slot or cam groove 26 formed therein as shown in FIGS. 1–3 that engages a valve pin 28. Valve pin 28 is connected to a manually operated valve 30 for controlling the hydraulic fluid flow throughout a valve assembly 32 in an automatic transmission. As such, the rotation of manual lever 14 causes pin 20 to engage pin slot 22 so as to linearly translate coding plate 24 to predetermined positions, which in turn controls the hydraulic system of the transmission.

A sensing unit 33 is mounted above a portion of coding plate 24 for sensing the position of coding plate 24. Sensing unit 33 is fastened to a valve body 34 in a known manner. A channel 36 is provided between sensing unit 33 and valve body 34 as shown in FIGS. 1 and 2, which allows coding plate 24 to slide linearly relative to sensing unit 33.

Sensing unit 33 includes five spring loaded electrical contact pins C1 through C5 that extend therefrom and contact conductive and non-conductive areas on a contact surface on coding plate 24. In this regard, it should be understood that the electrical contact pins C1 through C5 extend in a generally perpendicular relationship to the plane of coding plate 24. Sensing unit 33 still further includes a support member 38 that supports and stabilizes sensing unit 33 and provides substantially uniform contact between each of the electrical contacts C1 through C5 and coding plate 24. Sensing unit 33 further includes an electrical connection member 40 that is connected to a transmission controller 42.

Figure 4:
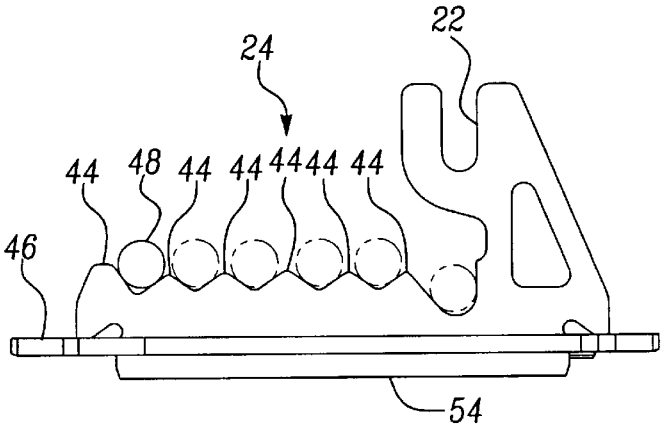
FIG. 4 is a side view of the linearly translated plate member.
Figure 5:
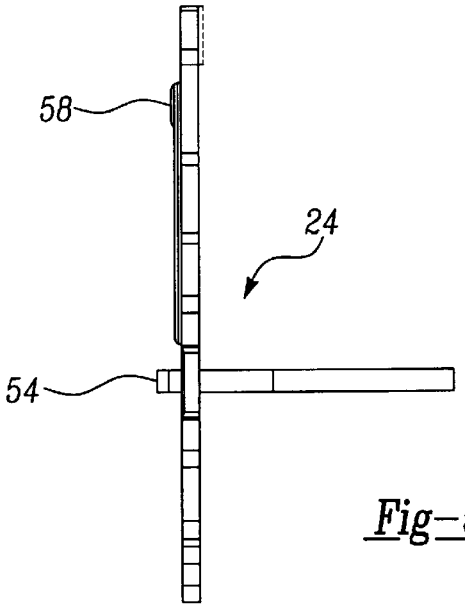
FIG. 5 is an end view of the linearly translated plate member.

Referring to FIGS. 3–5, Coding plate 24 has cam groove 26 routed therethrough to provide a cam surface for receiving the manually operated valve pin 28. As such, linear translation of coding plate 24 causes valve pin 28 to move manually operated valve 30 back and forth in accordance with predetermined valve settings. Coding plate 24 further includes raised notches 44 formed perpendicular to contact surface 46 for engaging a detent spring 48. As coding plate 24 is linearly translated, detent spring 48 engages operating notches 44 for each of the operating modes (PRND2L).

Contact surface 46 of coding plate 24 includes non-conductive areas 50 and conductive areas 52 formed thereon in a predetermined design to cooperate with contacts C1 through C5 in creating the desired binary code. As can be appreciated, non-conductive areas 50 and conductive areas 52 are orientated in a simple X-Y coordinate system to facilitate simple and convenient manufacture thereof. Therefore, improvements in manufacturing accuracy may be realized due to the specified design of the present invention relative to previous arcuate design patterns. Coding plate 24 further includes a guide rib 54 formed on the underside of coding plate 24. Guide rib 54 engages a guide channel 56 formed in valve body 34 to ensure proper linear translation of coding plate 24. Still further, coding plate 24 maintains an electrical ground contact with valve body 34, generally at reference 58, as the underside of coding plate 24 is retained in sliding engagement with valve body 34 by sensing unit 33 and detent spring 48. Preferably, coding plate 24 is made of a simple steel (or other metal) stamping that is locally overmolded with a non-conductive plastic, such as nylon.

As coding plate 24 is moved between the plurality of operating modes, non-conductive areas 50 and conductive areas 52 travel across the electrical contacts C1 through C5. In doing so, sensing unit 33 senses either conductive or non-conductive contact for each of the electrical contacts C1 through C5. Electrical contact with conductive area 52 grounds the electrical contact and thereby generates a binary "0". In contrast, electrical contact with non-conductive area 50 generates a binary code "1".

The binary codes generated by each of the electrical contacts C1 through C5 are then provided to transmission controller 42. Transmission controller 42 preferably compares the binary codes with predetermined combinations of binary codes to determine the position of manual lever assembly 12.

In operation, manual input to valve body assembly 10 actuates and determines the position of coding plate 24. A vehicle operator manually moves manual lever 14 via a shift linkage mechanism to select one of a plurality of operating modes (PRND2L). In doing so, manual lever 14 rotates in a plane generally perpendicular to the plane of coding plate 24. Rotation of manual lever 14 causes pin 20 to cam within pin slot 22 of coding plate 24. Specifically, pin 20 of manual lever 14 exerts a force upon pin slot 22 generally parallel to guide channel 56. This force on pin slot 22 causes coding plate 24 to linearly translate along valve body 34 so that electrical contacts C1 through C5 contact non-conductive areas 50 and conductive areas 52 to generate the combinations of binary codes that represent the position of coding plate 24. The combinations of binary codes provide for operating codes that are separated by transition codes. The binary coded combinations are then provided to transmission controller 42. Transmission controller 42 may thereby compare the binary codes with predetermined combinations of codes to determine the position of coding plate 24 and ensure proper operation of the transmission.

It should be appreciated that the present invention provides a coding plate that is simple to accurately manufacture. Furthermore, the present invention provides a reliable and accurate method of actuating the manual valve; while, simultaneously, provides a reliable and accurate method of sensing the position of the coding plate. The linear translation of the coding plate provides an improved camming action to minimize bind between the valve pin and the cam groove. Still further, by forming the cam groove, the detent notches, and the conductive and non-conductive areas relative to each other on a single, linearly-translated member, the mechanical, electrical, and hydraulic events are accurately related and the controller can more accurately detect the operating mode selected and the actual position of the manual valve.

The invention being thus described, it will be obvious that the same may be varied in many ways. Such variations are not to be regarded as a departure from the spirit and scope of the invention. Such variations or modifications, as would be obvious to one skilled in the art, are intended to be included within the scope of the following claims.

What is claimed is:

1. A valve assembly for directing fluid flow between a fluid source and a fluid actuating device in a transmission of a vehicle, said assembly comprising:

a first member being actuated in response to a manual input, said first member being positionable in a plurality of positions corresponding to predetermined operating modes of the transmission;

a valve body having valve means for directing fluid flow between the fluid source and the fluid actuating device;

a linearly translated member being operably coupled to said first member to linearly translate said linearly translated member relative to said valve body;

cam means for positioning said valve means at a predetermined position corresponding to said plurality of positions of said first member when said linearly translated member is linearly translated.

2. The assembly according to claim 1 wherein said cam means comprises:

a cam slot formed in said linearly translated member; and a pin member interconnecting said valve means and said linearly translated member and being movable in said cam slot.

3. The assembly according to claim 2 wherein said cam slot defines a park position, a reverse position, a neutral position, a drive position, a second gear position, and a first gear position for a park, a reverse, a neutral, a drive, a second gear, and a low operating mode of the transmission, respectively.

4. The assembly according to claim 1, further comprising:

a guide slot formed on said valve body; and a guide rib formed on said linearly translated member, said guide rib being adjacent said valve body such that said guide rib slideably engages said guide slot of said valve body to enable aligned linear translation of said linearly translated member relative to said valve body.

5. The assembly according to claim 1, further comprising:

a detent spring mounted on said valve body;

a plurality of detent notches formed on said linearly translated member corresponding to said predetermined operating modes, said detent spring engaging said plurality of detent notches.

6. The assembly according to claim 1, further comprising:

a drive slot formed on said linearly translated member; and a drive pin formed on said first member, said drive pin engaging said drive slot formed on said linearly translated member, whereby actuation of said first member in response to said manual input causes said drive pin to cam within said drive slot of said linearly translated member, thereby linearly translating said linearly translated member relative to said valve body.

7. A valve assembly for directing fluid flow between a fluid source and a fluid actuating device in a transmission of a vehicle, said assembly comprising:

a manual lever being actuated in response to a manual input, said manual lever being positionable in a plurality of positions corresponding to predetermined operating modes of the transmission;

a valve body;

valve means disposed in said valve body and being movable therein for directing fluid flow between the fluid source and the fluid actuating device;

a plate member slidably engaging said valve body, said plate member being operably coupled to said manual lever to linearly translate said plate member relative to said valve body;

a pin member interconnecting said plate member and said valve means; and cam means for positioning said valve means at a predetermined position corresponding to said plurality of positions of said manual lever when said plate member is linearly translated.

8. The assembly according to claim 7 wherein said cam means comprises a cam slot formed in said plate member, said pin member being disposed and movable in said cam slot.

9. The assembly according to claim 8 wherein said cam slot defines a park position, a reverse position, a neutral position, a drive position, a second gear position, and a first gear position for a park, a reverse, a neutral, a drive, a second gear, and a low operating mode of the transmission, respectively.

10. The assembly according to claim 7, further comprising:

a guide slot formed on said valve body; and a guide rib formed on said plate member, said guide rib being adjacent said valve body such that said guide rib slideably engages said guide slot of said valve body to enable aligned linear translation of said plate member relative to said valve body.

11. The assembly according to claim 7, further comprising:

a detent spring mounted on said valve body;

a plurality of detent notches formed on said plate member corresponding to said predetermined operating modes, said detent spring engaging said plurality of detent notches.

12. The assembly according to claim 7, further comprising:

a drive slot formed on said plate member; and a drive pin formed on said manual lever, said drive pin engaging said drive slot formed on said plate member, whereby actuation of said manual lever in response to said manual input causes said drive pin to cam within said drive slot of said plate member, thereby linearly translating said plate member relative to said valve body.

13. A valve assembly for directing fluid flow between a fluid source and a fluid actuating device in a transmission of a vehicle, said assembly comprising:

a manual lever being actuated in response to a manual input, said manual lever being positionable in a plurality of positions corresponding to predetermined operating modes of the transmission;

a valve body having valve means disposed within said valve body, said valve means being movable within said valve body for directing fluid flow between the fluid source and the fluid actuating device, said valve body further having a guide slot formed thereon;

a plate member having a guide rib formed thereon, said plate member being operably coupled to said manual lever, said guide rib of said plate member being adjacent said valve body such that said guide rib slideably engages said guide slot of said valve body to enable aligned linear translation of said plate member relative to said valve body;

a pin member interconnecting said plate member and said valve means; and cam means for positioning said valve means at a predetermined position corresponding to said plurality of positions of said manual lever when said plate member is linearly translated.

14. The assembly according to claim 13 wherein said cam means comprises an irregular cam slot formed in said plate member, said pin member being disposed and movable in said cam slot.

15. The assembly according to claim 14 wherein said cam slot defines a park position, a reverse position, a neutral position, a drive position, a second gear position, and a first gear position for a park, a reverse, a neutral, a drive, a second gear, and a low operating mode of the transmission, respectively.

16. The assembly according to claim 13, further comprising:

a detent spring mounted on said valve body;

a plurality of detent notches formed on said plate member corresponding to said predetermined operating modes, said detent spring engaging said plurality of detent notches.

17. The assembly according to claim 13, further comprising:

a drive slot formed on said plate member; and a drive pin formed on said manual lever, said drive pin engaging said drive slot formed on said plate member, whereby actuation of said manual lever in response to said manual input causes said drive pin to cam within said drive slot of said plate member, thereby linearly translating said plate member relative to said valve body.

* * * * *